United States Patent [19]

Reed et al.

[11] 4,388,709

[45] Jun. 14, 1983

[54] FUNNEL CONSTRUCTION FOR A DIPPING SONAR

[75] Inventors: Chester L. Reed, Burbank; Robert M. Bridges, Northridge, both of Calif.

[73] Assignee: The Bendix Corporation, Sylmar, Calif.

[21] Appl. No.: 225,894

[22] Filed: Jan. 19, 1981

[51] Int. Cl.[3] ..... B63B 21/16

[52] U.S. Cl. ..... 367/131; 114/244; 244/137 R; 367/106

[58] Field of Search ..... 367/106, 130, 173, 131; 114/244, 248, 254; 244/137 R

[56] References Cited

U.S. PATENT DOCUMENTS 3,805,977 4/1974 Fritzsche et al. ..... 244/137 R 4,132,973 1/1979 Orme ..... 367/106

*Primary Examiner*—Richard A. Farley

*Attorney, Agent, or Firm*—Robert C. Smith; William F. Thornton

[57] ABSTRACT

A funnel construction for a dipping sonar system carried in a helicopter includes the opening to a cylindrical housing of glass epoxy material for storing an underwater transducer which is deployed by suspending it into a body of water at the end of a thin cable. The housing opening includes a flared funnel structure including an entrance aperture member of thin wall aluminum alloy, a backing structure including a frustoconical strut member secured to the bottom of the helicopter and a resilient foam material positioned between and bonded to the entrance aperture member and the strut member which permits the entrance aperture member to move somewhat when impacted by the transducer. The aluminum alloy material in the entrance aperture is very light and yet transfers the heat of friction from rubbing of the small diameter cable against itself sufficiently rapidly that very little wear or damage is caused to either the cable or the funnel structure from repeated high speed reeling cycles.

9 Claims, 3 Drawing Figures

FUNNEL CONSTRUCTION FOR A DIPPING SONAR

Figure 1:
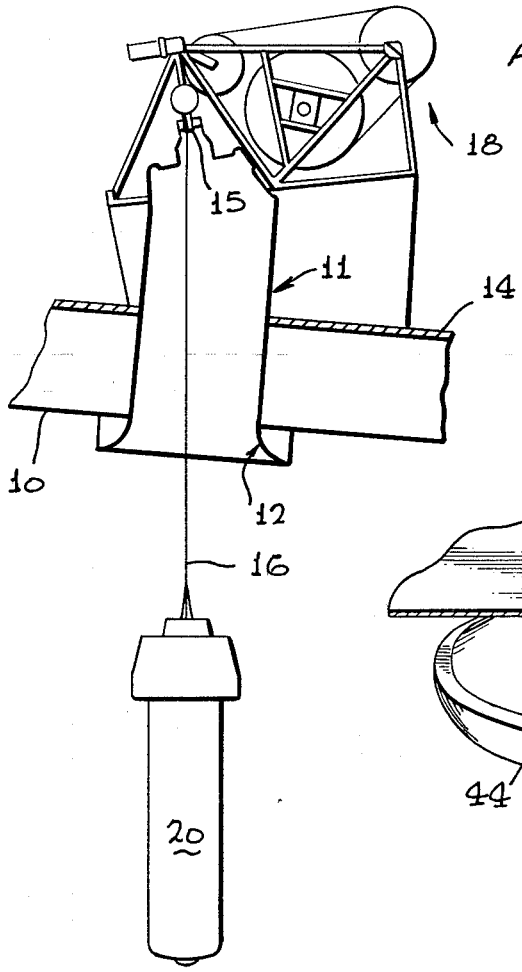

This invention relates to a funnel construction for a dipping sonar system carried in a helicopter. Such a system normally includes transmitting, receiving and display equipment, a hoist, a cable storage drum with a length of cable connected to the sonar equipment, and an underwater transducer attached to the opposite end of the cable which transmits echo ranging sonar signals and receives reflected sonar signals. For normal travel of the helicopter the cable is wound on the drum, and the transducer is secured in a housing formed in the floor of the helicopter. When the helicopter reaches a location where it is desired to search, the hoist is operated to pay the cable out and the transducer lowered into the water. At the time it is desired to move to another location or to return to a base, the cable is wound back onto the drum, passing through the housing. The entrance to the housing is flared, like a funnel, and because of the difficulty of holding the helicopter either absolutely straight and level or directly over the transducer, the cable frequently approaches the helicopter at an angle and after breaking free of the water makes contact with the sides of the funnel. The hoist continues to wind cable in until the transducer is again secured in the housing.

Most of the systems currently in use have a transducer of considerable diameter suspended from a cable having a diameter of approximately 2 cm, more or less, and a maximum length of two to three hundred meters. Because of the limited length of cable reeling speeds are modest, and wear on either the cable or the funnel-shaped entrance to the housing caused by contact between the cable and the housing has not been a serious problem. Recent airborne sonars of the type discussed above are designed to operate at much greater depths. The necessarily greater length of cable puts a premium on reducing cable size, and certain new cable designs carry as much or more information in a diameter of less than one cm as did the two cm diameter types described above. The additional length of cable also puts a premium on being able to deploy and recover the transducer rapidly, thus necessitating considerably faster reeling speeds. With a substantially smaller diameter cable reducing contact area and much faster reeling speeds, contact of the cable with the funnel-shaped housing entrance soon manifested itself in damage to both the cable and the funnel--especially to the funnel which became grooved with relatively little use. This pointed to a need for a new funnel design which would not show such erosion and which would not contribute to deterioration of the cable.

This invention comprises a funnel construction for a dipping sonar system in which the flared entrance aperture for guiding a transducer into its housing, rather than being of glass epoxy material or similar plastic like the remainder of the transducer housing, is of a thin sheet of aluminum alloy spun to the desired funnel-like configuration and bonded to a cylindrical housing member of glass epoxy material. An aluminum alloy strut member or backing member is actually in the form of a truncated cone and includes an axially arranged skirt section at the large diameter end and an axially inwardly extending section on the small diameter end which is concentrically outside of and only slightly larger than the lower end of the cylindrical housing members. A radially extending flange forms an extension of this strut member. Resilient foam material is placed between the entrance aperture member and the strut member and bonded thereto. The assembly is then fastened to the aircraft by means of fastening members which attach the flange to the edge of the opening for the housing.

Extensive and severe testing has shown that various types of plastic materials used for funnels erode and wear away quickly from the heat and friction resulting from high speed travel and tension of the small diameter cable across the flared funnel member. By making the funnel itself of thin aluminum alloy, it appears that the aluminum alloy carries off heat very rapidly and avoids the localized heat build-up which causes the plastic funnel members to wear away rapidly, thus also causing wear and deterioration of the cable. Other metals might be used but only at a weight penalty, and most will not carry heat away as effectively as the aluminum alloy. The alloy which was preferred is Number 6061-T6, 1 AW QQ-A-250/11 approximately 0.2 cm thick.

Figure 2:
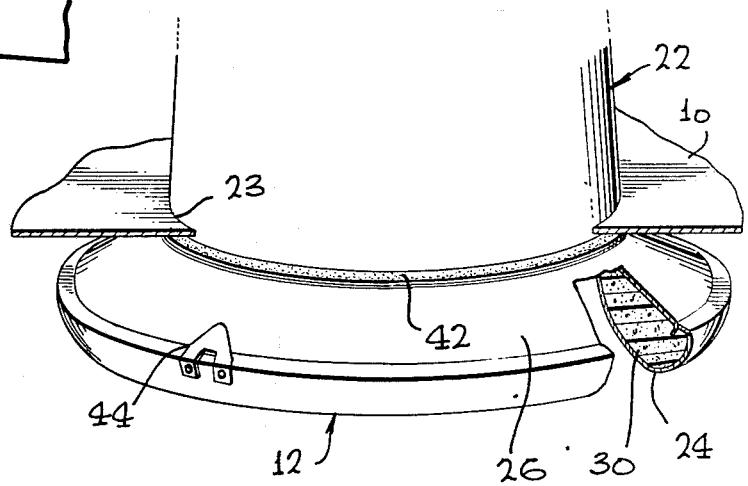
Figure 3:
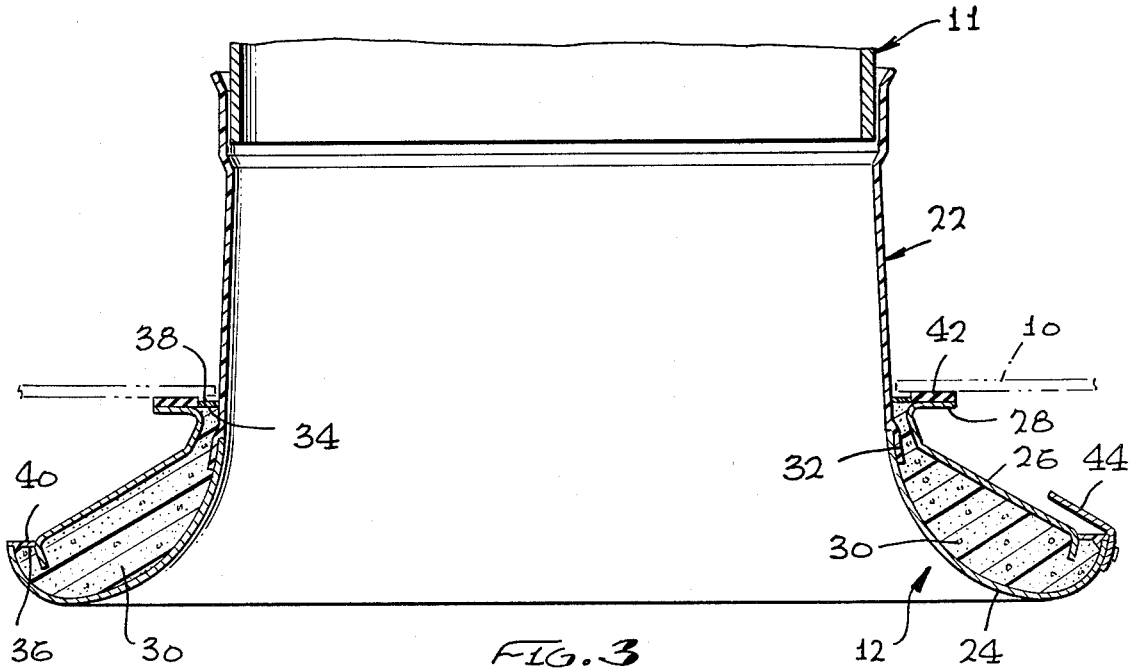

The invention will now be described with respect to the accompanying drawings in which FIG. 1 is a schematic view of an airborne sonar system of the type incorporating the invention;

FIG. 2 is a perspective view, partly in section, of the funnel structure incorporating the invention; and FIG. 3 is a sectional view of the funnel structure of FIG. 2.

Referring now to FIG. 1, the bottom of a helicopter body is shown at numeral 10 having an opening in which is placed a transducer housing 11. The funnel portion 12 of the housing is attached to the helicopter body 10 by means discussed below and housing 11 is attached to the helicopter floor 14. At the top of the housing 11 is a port 15 through which passes a cable 16 which is wound on a hoist and drum structure 18. An underwater transducer 20 is suspended from the cable 16 and may be either lifted by the hoist 18 up into the housing 11 or lowered into a body of water, as desired. As will be appreciated from this drawing, the transducer 20 is free to swing in a wide arc and can also rotate around a circle. During deployment the transducer 20 will normally drop straight down into the water, but once in the water it will tend to follow the helicopter, thus causing the cable to be suspended at an angle which may cause it to rub against the side of the housing. Upon recovery the transducer 20 frequently swings in a wide arc as well as in a circle which will tend to cause the rapidly moving cable 16 to rub on the side of the housing. The transducer 20 may also impinge rather heavily on the funnel 12 which makes it desirable to protect both the transducer and the funnel from damage from this source.

FIG. 2 is a perspective view, partly in section, of the funnel structure shown schematically in FIG. 1. The funnel structure 12 includes a cylindrical housing member 22 of glass epoxy material which passes through an opening 23 in the bottom 10 of the helicopter. Member 22 is bonded to an entrance aperture member 24 which is spun of thin wall aluminum alloy and is flared into a bellmouth shape, as shown. Also forming part of the funnel structure 12 is an annular strut member 26 which is generally frustoconical and which includes a radially extending flange 28 which is fastened to the bottom 10 of the helicopter body. The space between members 24 and 26 is filled with a resilient foam material 30 which permits some relative movement between these members. The above structure may become more clearly understood from consideration of FIG. 3 which is a sectional drawing of the funnel structure 12. In this view cylindrical housing member 22 is shown as having a slightly expanded diameter at each end. At the upper end, the larger diameter receives a cylindrical housing section 11 forming no part of the present invention. At the lower end the larger diameter section 32 telescopes over and is bonded to the smaller diameter end of entrance aperture member 24. The annular strut member 26, which is also of thin wall aluminum alloy, is shown as positioned concentrically outside of the larger diameter section 32 of housing member 22. It includes an axially extending skirt which is angled slightly inwardly at its large diameter end and an inwardly tapering but generally axial extension at its smaller diameter end terminating in a radially outwardly extending flange 28. Foam material 30 is shown positioned between members 24 and 26 and terminating in a first surface 34 extending between the wall of housing member 22 and flange 28, and a second surface 36 extending between the large diameter lip of member 24 and the axially extending skirt of member 26. Surfaces 34 and 36 are sealed by means of moisture-proof urethane seals 38 and 40, respectively. A gasket 42 of rubber or other suitable material is fastened to the flange 28 to provide a seal against the bottom 10 of the helicopter. A plurality of safety clips 44 are fastened to the large diameter lip of member 24 such that they extend inwardly over the surface of strut member 26. Strut member 26 is fastened to the helicopter bottom 10 at flange 28, and it is quite secure; however, the entrance aperture member 24 is fastened only by the bond at section 32 and by the bonds between itself and the resilient foam 30. This arrangement permits member 24 to move significantly relative to strut member 26 when it receives an impact from transducer 20.

From the foregoing, it will be appreciated that the funnel structure described herein provides a means of permitting very rapid deployment and recovery of a transducer suspended from a cable as small as 0.6 cm diameter with minimal damage to either the cable or the entrance aperture member. The entrance aperture member is very light in weight, yet transfers and dissipates frictional heat very effectively. The resilient mounting of the entrance aperture effectively absorbs impact from the transducer without significant damage to either the transducer or the entrance aperture member.

We claim:

1. A funnel construction for a dipping sonar carried in a helicopter, said sonar including a hoist with a cable-carrying drum, a cable attached to said drum, and an underwater transducer attached to said cable, said hoist being capable of lowering said transducer into and out of a body of water from said helicopter, and a housing in said helicopter for receiving and storing said transducer, said funnel forming an opening into said housing characterized in that said funnel construction includes a first cylindrical member having a slightly expanded diameter at its top rim and its lower rim, said cylindrical member passing through an opening in the bottom of said helicopter, a flared cylindrical entrance aperture member of thin wall, aluminum alloy having its smaller end in telescoping relation with said lower rim and bonded thereto, and terminating its flared end in a large diameter annular lip extending in the same direction as its smaller end, a partially conical strut member of aluminum alloy having a short length of axially inwardly extending annular skirt at its larger diameter end, terminating adjacent said annular lip, an inwardly tapered axially extending section at its smaller diameter end which is slightly larger than the diameter of said lower rim and positioned adjacent thereto, and terminating in a radially outwardly extending flange, a quantity of resilient foam material positioned between said strut member and said entrance aperture member and extending over said lower rim to a first surface adjacent said flange and also to a second surface between said large diameter annular lip and said axially inwardly extending annular skirt, sealing means sealing said first and second surfaces, and means fastening said flange to said helicopter.

2. A funnel construction for a dipping sonar as claimed in claim 1 wherein said fastening means includes a gasket of resilient material positioned between said flange and the edges of said opening.

3. A funnel construction for a dipping sonar as claimed in claim 1 wherein said first cylindrical member is of glass epoxy material.

4. A funnel construction for a dipping sonar as claimed in claim 1 wherein a plurality of safety clips are fastened to said annular lip and extend inwardly over the surface of said strut member.

5. A funnel construction for a dipping sonar as claimed in claim 3 wherein said housing also includes a second cylindrical member fitting in telescoping relationship with the top rim of said first cylindrical member.

6. A funnel construction for a dipping sonar system carried in a helicopter, said sonar including an underwater transducer and means in said helicopter including a cable for lowering said transducer into a body of water and for returning said transducer into said helicopter, and a generally cylindrical housing in said helicopter for storing said transducer, said funnel forming an opening into said housing, characterized in that said funnel construction includes a first cylindrical member of glass epoxy material slightly larger in diameter than said transducer, a flared cylindrical entrance aperture member of thin wall aluminum alloy having its smaller end in telescoping relation with the lower end of said first cylindrical member and bonded thereto and terminating its flared end in a large diameter annular lip extending in the same direction as its smaller end, a partially conical strut member of thin wall aluminum alloy having a short length of axially inwardly extending skirt at its larger diameter end terminating adjacent said annular lip and substantially concentric therewith, an inwardly tapering axially extending section at its smaller diameter end which is slightly larger than the diameter of the lower end of said first cylindrical member and substantially concentric therewith and terminatng in a radially outwardly extending flange, a quantity of resilient foam material positioned between said strut member and said entrance aperture member and bonded thereto, and means fastening said flange to said helicopter.

7. A funnel construction for a dipping sonar as claimed in claim 6 wherein said fastening means includes a gasket of resilient material positioned between said flange and the bottom of said helicopter.

8. A funnel construction for a dipping sonar as claimed in claim 6 wherein a plurality of safety clips are fastened to said annular lip and extend inwardly over the surface of said strut member.

9. A funnel construction for a dipping sonar as claimed in claim 6 wherein said resilient foam material terminates in a first surface adjacent said flange and a second surface adjacent said large diameter annular lip and sealing means are provided sealing said first and second surfaces.

* * * * *